US005704137A

United States Patent [19]

Dean et al.

[11] Patent Number: 5,704,137

[45] Date of Patent: Jan. 6, 1998

[54] SHOE HAVING HYDRODYNAMIC PAD

[75] Inventors: Todd Dean, Kirkland; Eric Dreyer, Redmond, both of Wash.; Raymond M. Fredericksen, East Lansing, Mich.

[73] Assignee: Brooks Sports, Inc., Bothell, Wash.

[21] Appl. No.: 576,958

[22] Filed: Dec. 22, 1995

[51] Int. Cl.[6] ..... A43B 13/18; A43B 19/00

[52] U.S. Cl. ..... 36/28; 36/29; 36/71

[58] Field of Search ..... 36/29, 71, 35 R, 36/37, 35 B, 28

[56] References Cited

U.S. PATENT DOCUMENTS

| | | | |
|---|---|---|---|
| 2,917,843 | 12/1959 | Scholl | 36/71 |
| 3,331,146 | 7/1967 | Karras | 36/3 |
| 3,754,339 | 8/1973 | Terasaki | 36/3 B |
| 3,795,994 | 3/1974 | Ava | 36/29 |
| 4,115,934 | 9/1978 | Hall | 36/44 |
| 4,763,426 | 8/1988 | Polus et al. | 36/29 |
| 4,768,295 | 9/1988 | Ito | 36/28 |
| 4,878,300 | 11/1989 | Bogaty | 36/35 B |
| 4,934,072 | 6/1990 | Fredericksen et al. | 36/29 |
| 5,086,574 | 2/1992 | Bacchiocchi | 36/35 R |
| 5,097,607 | 3/1992 | Fredericksen | 36/291 |
| 5,131,174 | 7/1992 | Drew et al. | 36/35 B |
| 5,167,999 | 12/1992 | Wang | 428/178 |
| 5,175,946 | 1/1993 | Tsai | 36/29 |
| 5,295,313 | 3/1994 | Lee | 36/3 R |
| 5,313,717 | 5/1994 | Allen et al. | 36/35 B |
| 5,363,570 | 11/1994 | Allen et al. | 36/29 |
| 5,493,792 | 2/1996 | Bates et al. | 36/28 |
| 5,545,463 | 8/1996 | Schmidt et al. | 36/35 B |
| 5,575,088 | 11/1996 | Allen et al. | 36/71 |

*Primary Examiner*—M. D. Patterson

*Attorney, Agent, or Firm*—Seed and Berry, LLP

[57] ABSTRACT

A hydrodynamic pad including fluid-filled inner and outer bladders interconnected by fluid channels and configured such that displacement of fluid from the center of pressure distribution generated by foot impact radiates from the inner bladder outwardly to the outer bladder through one or more of the fluid channels causing the outer bladder to expand to an expanded condition. The expanded outer bladder seats the wearer's heel in the hydrodynamic pad, thereby stabilizing the foot of the wearer, and the controlled flow of fluid through the fluid channels to the outer bladder dissipates the impact loads, thereby cushioning the wearer's heel. When the pressure is released from the inner bladder, by lifting the wearer's heel, the expanded outer bladder forces at least a portion of the displaced fluid to the inner bladder, such that the hydrodynamic pad is reinitialized.

19 Claims, 3 Drawing Sheets

SHOE HAVING HYDRODYNAMIC PAD

TECHNICAL FIELD

The present invention relates to shoes and components thereof, and more particularly to stabilizing and cushioning systems for shoes.

BACKGROUND OF THE INVENTION

During sustained activity, an individual's feet are subjected to large, repetitious, ground reaction or impact forces generated in a gait cycle. The ground reaction forces associated with foot strike while walking are typically between one and one-and-one-half an individual's body weight. Runners impact the ground with vertical forces as high as three to four times their body weight, depending upon their speed. In more dynamic activities, such as aerobics and basketball, impact forces as high as five to six times an athlete's body weight have been recorded.

During the gait cycle of a runner, the runner's foot experiences ground reaction forces during the heel strike phase. The heel strike phase begins with the initial contact at the lateral or outer portion of the heel, and lasts until the rest of the foot or shoe contacts the ground, known as the flat foot phase. The flat foot phase lasts until the runner's heel lifts, thereby beginning the toe off phase. During the heel strike and the flat foot phases, the runner's foot typically pronates or supinates, and such pronation or supination will result in lateral movement of the runner's heel if the heel is not adequately stabilized. The typical running shoe attempts to stabilize the runner's heel by providing a generally rigid heel cup that is shaped to snugly receive the runner's heel. However, the heel cups are padded for comfort, and the padding is compressible. Accordingly, the runner's heel experiences a degree of lateral movement relative to the heel cup as the heel is moved against the padding and the padding is compressed.

The ground reaction forces experienced as the runner's foot is in contact with the ground are partially attenuated through a complex natural three-dimensional motion of the foot at the subtalar, metatarsal, other joint areas, and the calcaneous bone. Those areas of focused impact are generally concentrated in the heel and metatarsal regions of the foot. Accordingly, it is desirable to dissipate the impact forces and to limit joint motion beyond the natural motion of the foot.

Many components and materials are known which provide cushioning that attenuate and dissipate ground reaction forces. Prior art shoes have long incorporated a midsole composed of closed cell viscoelastic foams, such as ethylvinylacetate ("EVA") and polyurethane ("PU"). EVA and PU are lightweight and stable foam materials which possess viscous and elastic qualities. The density or durometer, i.e., hardness, of EVA and PU can be altered by adjusting the manufacturing technique to provide differing degrees of cushioning.

Viscoelastic foam midsoles, however, suffer a breakdown of their resiliency, or elasticity, when subjected to the repetitive compression resulting from foot impact. Thus, the cushioning provided by the "spring" of such viscoelastic midsoles is diminished or depleted over time by the repeated compression of wear.

A variety of alternate shoe structures less prone to breakdown have been derived for cushioning the impact of heel strike. Many of these include the use of gaseous and/or liquid chambers in the shoe sole. Often these are complex and costly, even to the point of being impractical.

Many prior sole structures or configurations for effecting cushioning extend over the forefoot and heel of the sole, either as one chamber extending the length of the sole, or as a heel chamber and a forefoot chamber connected by passageways. The forefoot chamber is normally provided to receive fluid from the heel chamber and then to force the fluid back to the heel chamber by pressure of the forefoot during foot roll and toeoff, too often resulting in instability beneath the foot. This instability of the sole structure allows excessive pronation or supination. Moreover, such devices do not accommodate the different impact forces resulting from different speeds of an activity, e.g., running versus jogging. Thus, while serving to lessen the problems associated with impact force, these sole configurations do not provide sufficient stability to the foot, and particularly to the heel.

Recent commercial embodiments of shoes for cushioning impact include the use of a gel in the shoe soles by one manufacturer, and of a pressurized air bladder in the shoe soles by another manufacturer. Although devices do effect certain impact cushioning, tests show that the impact absorption of such devices still exhibits sharp peak impact loads considered undesirably high, particularly during sustained activity. Moreover, these commercial embodiments have the materials encapsulated under pressure and confined to a finite space; this encapsulation under pressure does not sufficiently accommodate different impact forces from persons of different weight or running at different speeds.

Athletic shoes have been designed to accommodate impact loads of faster gaits while maintaining a sufficient combination of stiffness and cushioning to comfortably accommodate impact loads during a slow gait. The athletic shoes utilize fluid-filled bladders wherein the controlled flow of fluid between a rearward and forward chamber, as discussed in U.S. Pat. Nos. 4,934,072 and 5,097,607, provides a cushioning system which dissipates impact loads in accordance to an individual runner's weight and gait.

SUMMARY OF THE INVENTION

The present invention provides a hydrodynamic pad for a shoe which stabilizes and cushions the foot of a wearer, thereby advantageously addressing problems associated with prior art cushioning constructs. The hydrodynamic pad of a preferred embodiment of the present invention achieves this stabilizing and cushioning by displacement of fluid between an inner bladder and an outer bladder. The inner bladder is adapted to be located in a shoe midsole at the center of pressure distribution generated by the compression generated during heel strike. The outer bladder is configured to coincide with the bottom periphery of the heel of the wearer, and the displacement of the fluid to the outer bladder causes the outer bladder to expand, thereby seating and stabilizing the wearer's heel during heel strike. The fluid displacement and the seating of the heel on the hydrodynamic pad maximizes cushioning and support of the wearer's heel.

More specifically, the hydrodynamic pad of a preferred embodiment is for insertion in the midsole of a shoe. The hydrodynamic pad includes an inner bladder having an anterior portion, a posterior portion, and two longitudinal side portions extending between the anterior and posterior portions. The outer bladder is positioned outwardly from at least the longitudinal side portions and the posterior portion of the inner bladder. Fluid channels extend between the inner bladder and the outer bladder so as to provide a fluid pathway therebetween, such that the fluid is movable between the inner and outer bladders. Upon application of a compressive force by a wearer's heel to the inner bladder, fluid is displaced from the inner bladder through the fluid channels to the outer bladder, thereby expanding the outer bladder and causing the outer bladder to seat the wearer's heel. The outer bladder is a resilient bladder, and the expanded outer bladder is capable of forcing at least a portion of the fluid to return to the inner bladder when at least a portion of the compressive force is removed from the inner bladder. Thus, when the compressive force is removed, such as by lifting the heel during the toe off phase, the outer bladder forces the fluid through the fluid channels such that the displaced fluid returns to the inner bladder and the outer bladder returns to an initial position.

In a preferred embodiment of the present invention, the outer bladder abuts at least the longitudinal side portions and posterior portion of the inner bladder. In an alternate embodiment, the hydrodynamic pad includes a multiplicity of outer bladders radially spaced away from the anterior portion, longitudinal side portions, and posterior portion of the inner bladder.

In yet a further alternate embodiment of the present invention, a single, continuous outer bladder is spaced away from the anterior portion, longitudinal side portions and posterior portion of the inner bladder, and the inner and outer bladders are connected by the fluid channels.

The present invention further provides a method of stabilizing the foot while dissipating impact forces. In a preferred embodiment, the method includes the steps of providing the hydrodynamic pad, exerting a compressive force on the hydrodynamic pad with the heel of the foot and compressing the inner bladder such that at least a portion of the fluid in the inner bladder is forced outwardly through the fluid channels into the outer bladder, expanding the outer bladder from an initial position to an expanded position, and seating the heel in the outer bladder, thereby stabilizing the heel of the foot. A preferred method further includes removing the compressive force from the inner bladder, contracting the outer bladder and returning at least a portion of the fluid from the outer bladder through the fluid channels to the inner bladder.

The mechanisms of action and advantages of this hydrodynamic pad and method of the present invention are more fully described below, in relation to the illustrations provided in the accompanying drawings.

DETAILED DESCRIPTION OF THE INVENTION

Figure 2:
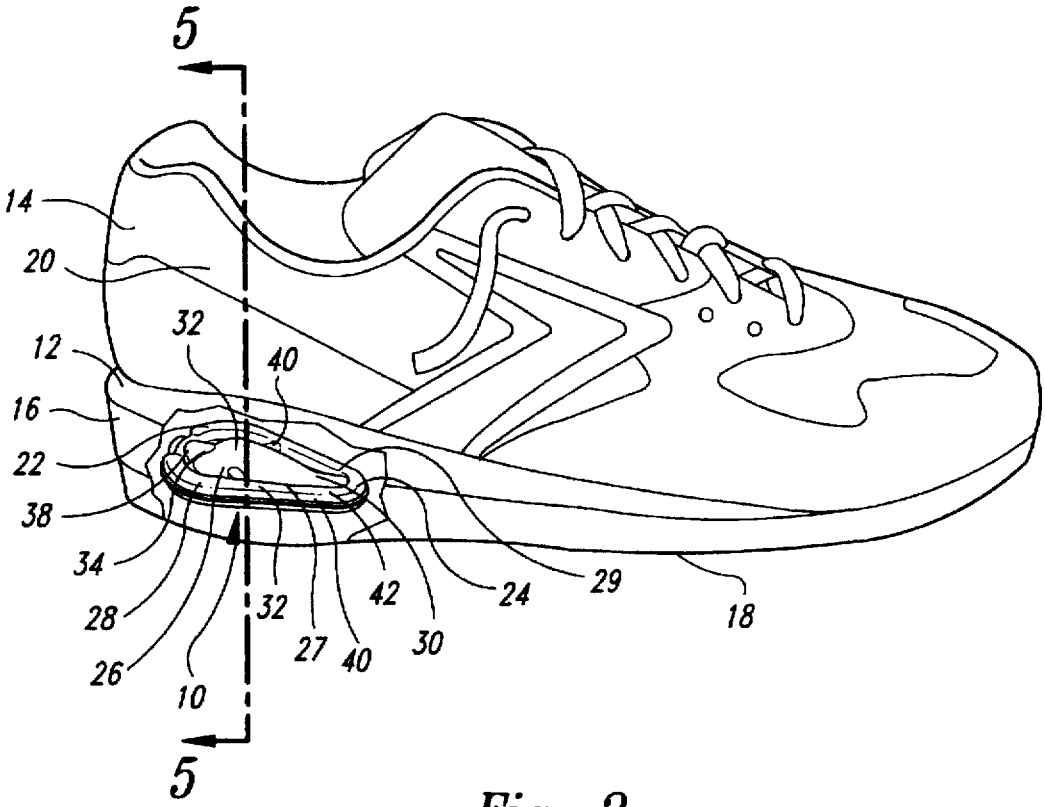
FIG. 2 is a partially cut-away, bottom isometric view of a shoe with a hydrodynamic pad in accordance with a preferred embodiment of the present invention.

In reference to the drawings in detail, FIG. 2 illustrates a hydrodynamic pad 10 in accordance with a preferred embodiment of the present invention. The hydrodynamic pad is located in the heel portion 12 of the midsole 16 of the shoe 14. This midsole is sandwiched between a shoe outsole 18 that contacts the ground and a shoe upper portion 20 that is shaped and sized to receive the wearer's foot. The hydrodynamic pad 10 is positioned in the midsole to be under the heel of the wearer's foot when the shoe is worn. As discussed in greater detail below, the hydrodynamic pad is constructed to dissipate ground reaction forces transmitted through the shoe to the wearer's heel during the heel strike phase of the wearer's gait cycle. The hydrodynamic pad 10 is also constructed to seat the wearer's heel so as to stabilize the heel from lateral motion relative to the shoe's upper portion 20 during the heel strike phase and the flat foot phase.

Figure 1:
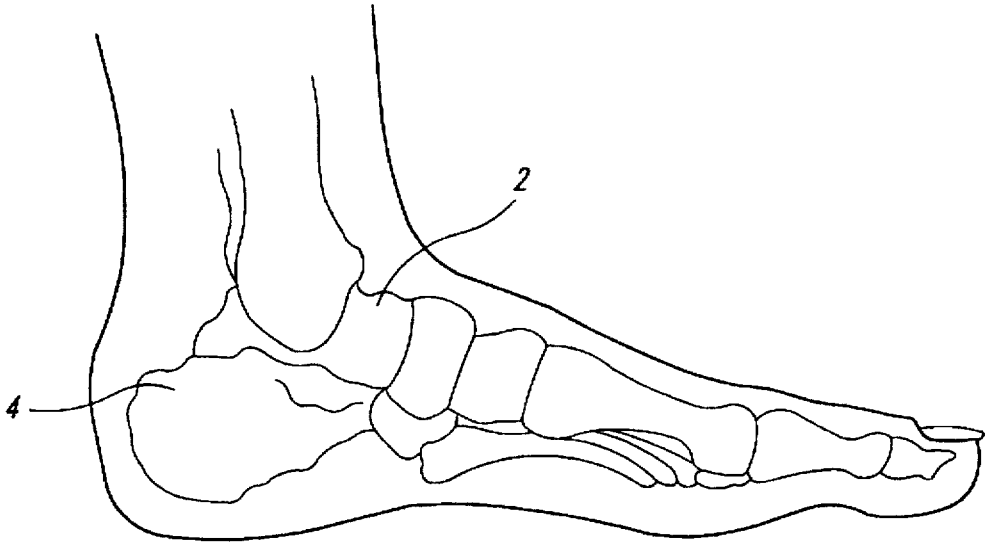
FIG. 1 is a schematic side view of the bones of a wearer's foot.

The hydrodynamic pad 10 of the illustrated embodiment has a generally teardrop shape that extends forwardly relative to the midsole 16 (FIG. 2) from a wide, rounded rear side 22 to a narrower rounded front side or apex 24 that points toward the toe of the shoe 14 (FIG. 2) when the hydrodynamic pad 10 is positioned within the midsole. The hydrodynamic pad 10 is shaped and sized to coincide with the shape of the heel and calcaneous bone 4 (FIG. 1) of the wearer's foot, with the periphery of the rounded rear side 22 being sized to extend around the sides and rear periphery of the wearer's heel. The rounded apex 24 is preferably positioned to be under the wearer's foot just forward of the calcaneous bone 4 (FIG. 1).

Figure 3:
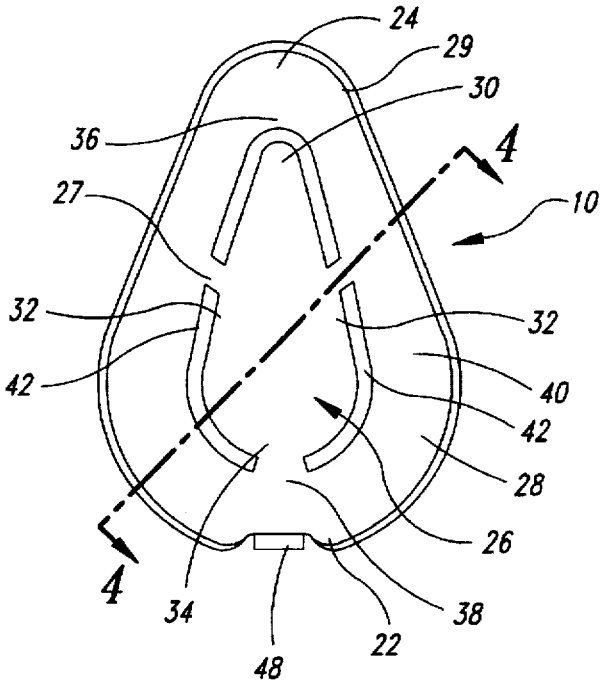
FIG. 3 is a plan view of the hydrodynamic pad of FIG. 2.
Figure 4:
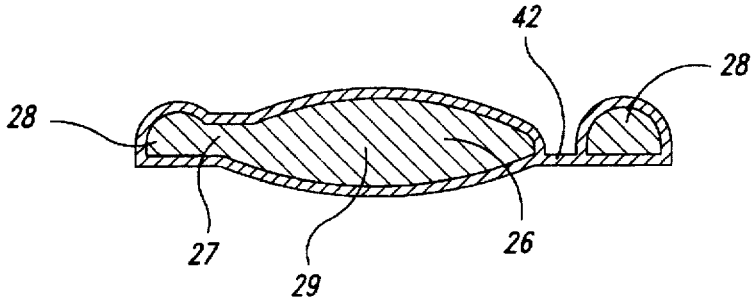
FIG. 4 is a cross-sectional view of the hydrodynamic pad of FIG. 3 taken substantially along line 4—4 of FIG. 3 showing the outer bladder in an initial position.

As best seen in FIGS. 2 and 3, the hydrodynamic pad 10 includes an inner bladder 26 that is connected by a plurality of fluid channels 27 to an outer bladder 28 positioned outwardly of the inner bladder. The inner and outer bladders 26 and 28, respectively, contain a viscous fluid 29 that is movable between the inner and outer bladders through the fluid channels. The inner bladder 26 has an anterior portion 30, two longitudinal side portions 32, and a posterior portion 34 that are interconnected, such that the inner bladder has a shape that generally corresponds to the shape of the wearer's heel and the calcaneous bone 4 (FIG. 4). Accordingly, the inner bladder 26 is positioned under the wearer's heel below the calcaneous bone 4 (FIG. 1), so as to absorb and dissipate impact forces generated during the heel strike phase.

The outer bladder 28 extends around and abuts the inner bladder 26, such that an anterior portion 36 of the outer bladder is forwardly adjacent to the inner bladder's anterior portion 30, a posterior portion 38 of the outer bladder is rearwardly adjacent to the inner bladder's posterior portion 34, and side portions 40 of the outer bladder are outwardly adjacent to the inner bladder's longitudinal side portions 32. The inner bladder 26 is separated from the outer bladder 28 by a common bladder wall 42, such the bladder wall defines the outer periphery of the inner bladder and the inner periphery of the outer bladder. The plurality of fluid channels 27 are formed in the bladder wall 42 and extend between the inner and outer bladders 26 and 28. The fluid channels 27 allow the fluid 29 contained in the inner and outer bladders 26 and 28 to move between the inner and outer bladders. When compressive impact forces are exerted on the inner bladder 26 by the heel of the wearer during the heel strike phase, the compression impact force causes the inner bladder to compress, thereby forcing a portion of the fluid 29 from the inner bladder, through the fluid channels 27, and into the outer bladder 28. As a result, the impact forces during heel strike are dissipated, thereby minimizing the forces transmitted to the wearer.

The fluid channels 27 are shaped and sized to provide a controlled and restricted flow of the fluid 29 between the inner and outer bladders 26 and 28, respectively, so as to accommodate different impact forces resulting from different weights of runners or different speeds of running. Accordingly, the flow of the fluid 29 between the inner and outer bladders 26 and 28 is regulated by the fluid channels 27 and the force applied to the inner bladder. When force is applied to the inner bladder 26 causing it to compress, fluid flow from the inner bladder to the outer bladder 28 will continue until either the force is removed, or pressure equilibrium between the inner and outer bladders is reached, or the fluid 46 is substantially emptied from the inner bladder.

Figure 5:
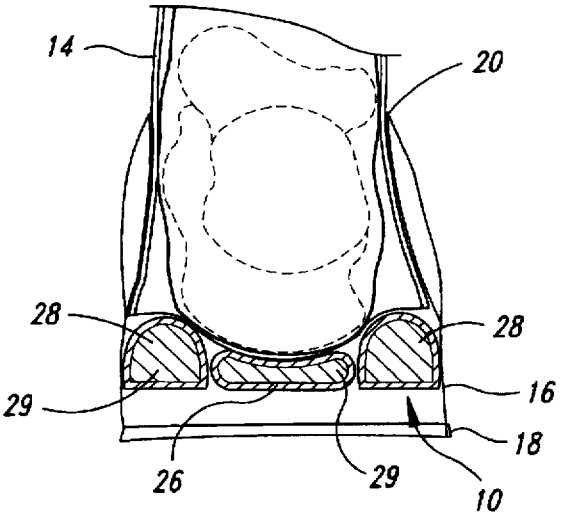
FIG. 5 is a cross-sectional view taken substantially along line 5—5 of FIG. 2, illustrating the correspondence between the hydrodynamic pad and the heel of the foot, shown in phantom lines when the outer bladder is in an expanded position.

The inner and outer bladders 26 and 28 are constructed of resilient, elastic, puncture-resistant material, which allows the inner bladder to move from an initial position illustrated in FIG. 4, to a compressed position, illustrated in FIG. 5, when the compressive impact force is exerted on the inner bladder during the heel strike phase. As the inner bladder 26 moves to the compressed position, at least a portion of the fluid 29 is forced out of the inner bladder, through the fluid channels 27, and into the outer bladder 28. To accommodate the increased volume of the fluid 29 in the outer bladder 28, the outer bladder expands from an initial position, illustrated in FIG. 4, to an expanded position, illustrated in FIG. 5. The outer bladder 28 expands upwardly around the periphery of the wearer's heel, as the heel sinks downwardly and the inner bladder 26 compresses, as shown in FIG. 5. Accordingly, the outer bladder 28 seats the wearer's heel and resists lateral movement of the heel relative to the hydroflow pad 10 and the shoe 14, thereby stabilizing the heel, particularly during the heel strike and the flat foot phases.

When the outer bladder 28 is in the expanded condition, the resilient elastic material forming the outer bladder is biased toward the initial condition, such that the expanded outer bladder forces the return of at least a portion of the fluid 29 from the outer bladder, through the fluid channels 27, and into the inner bladder 26, when the compressive force exerted on the inner bladder is reduced or removed. For example, during the toe off phase, the wearer's heel lifts relative to the ground such that the compressive force on the inner bladder 26 is substantially removed, and the fluid 29 is forced inwardly through the fluid channels 27 and the outer bladder 28 moves from the expanded condition to the initial condition. Simultaneously, the inner bladder 26 moves from the compressed condition to the initial condition, such that the hydroflow pad 10 is reinitialized and is ready to absorb and dissipate impact forces during heel strike while stabilizing the wearer's heel from lateral motion relative to the shoe 14.

In the preferred embodiment illustrated herein, the inner and outer bladders 26 and 28, and the fluid channels 27 are constructed of polyurethane to provide an elastic, puncture-resistant material. Examples of other suitable materials, for purposes of illustration, include polymethane or polyvinyl compositions, acetate, acrylics, cellulosics, fluorocarbons, nylons, polycarbonates, polyethylene, polybutylenes, polypropylenes, polystyrenes, or polyesters. The elastic, puncture-resistant material has a thickness of between 0.2–0.5 millimeters to provide sufficient resistance to punctures. The thickness of the material can be greater or less than 0.2–0.5 millimeters as needed for different designs to ensure puncture resistance of the hydrodynamic pad 10.

The preferred embodiment of the hydrodynamic pad 10 is constructed by joining together upper and lower layers of the elastic puncture-resistant material by heat sealing techniques so as to form the inner and outer bladder 26 and 28, the bladder wall 42, and the fluid channels 27 therein. As best seen in FIG. 3, a filling port 48 is connected to the posterior portion 38 of the outer bladder to allow the fluid 29 to be inserted into the inner and outer bladders 26 and 28 during manufacturing of the hydrodynamic pad 10. After the desired mount of fluid is added to the inner and outer bladders 26 and 28, the filling port 48 is permanently sealed to prevent fluid leakage after being inserted into the midsole.

The hydrodynamic pad 10 of the preferred embodiment is illustrated as a rounded teardrop or egg shape, and is typically between about 30–40 millimeters along its broadest transverse axis and between about 40–60 millimeters along its longest longitudinal axis. The inner bladder 26 and outer bladder 28 are between about 3–10 millimeters thick when they contain the fluid 29.

The hydrodynamic pad 10 is filled with the fluid 29 to a volume comprising between about 40 percent and about 90 percent of the capacity of the hydrodynamic pad. Preferably, the fluid 29 is a 1000 Centistoke silicon based fluid that fills between about 60 percent and about 80 percent of the volumetric capacity of hydrodynamic pad 10. Fluids suitable for use in the hydrodynamic pad 10 include any liquid or gaseous substance. Examples of other suitable fluids include water, glycerin, and oils, which may be combined with agents which increase viscosity of the fluid, such as, for example, guar, agar, cellulose materials, mineral thickeners, or silica.

Figure 6:
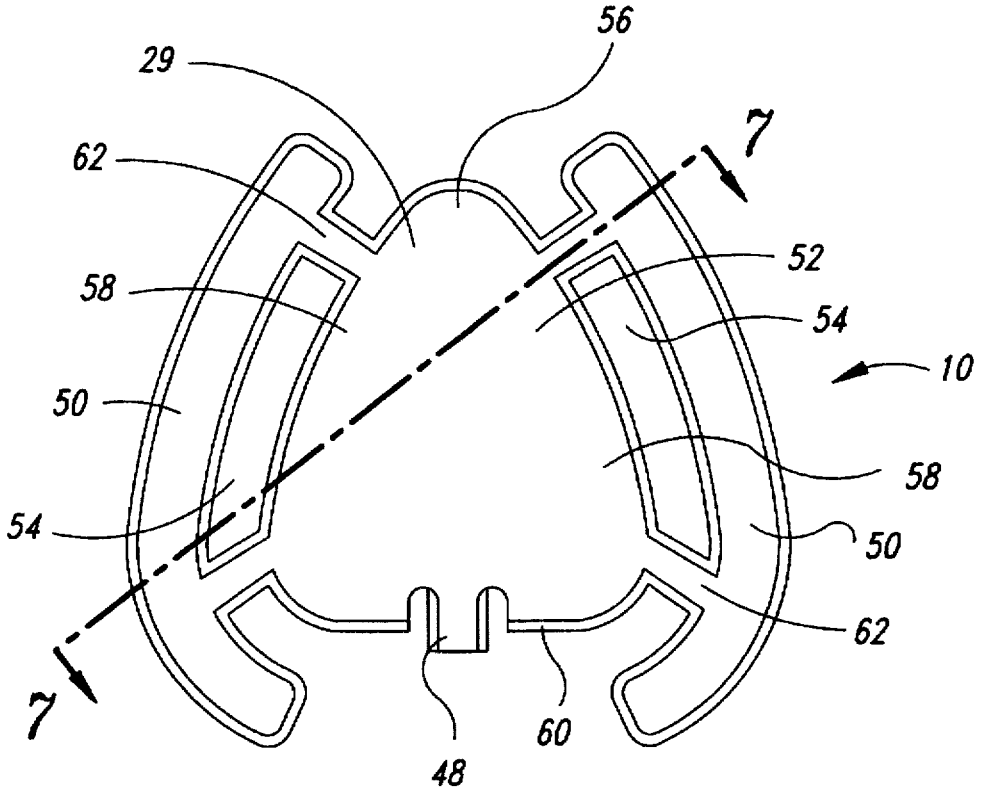
FIG. 6 is a top view of an alternate preferred embodiment of the hydrodynamic pad of the present invention.
Figure 7:
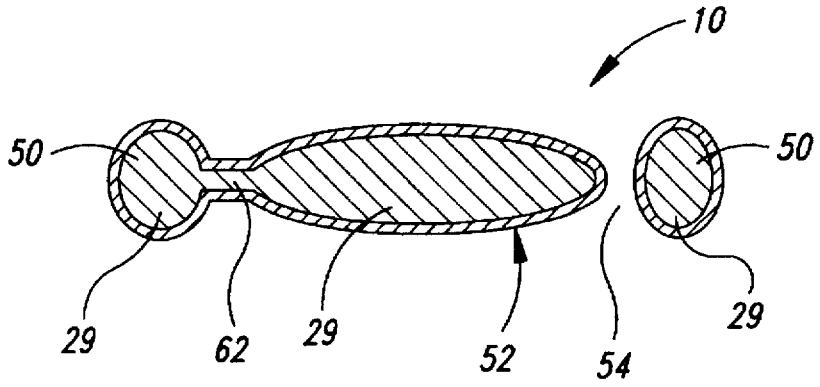
FIG. 7 is a cross-sectional view taken substantially along line 7—7 of FIG. 6.

In an alternate embodiment of the present invention illustrated in FIGS. 6 and 7, the hydrodynamic pad 10 includes two outer bladders 50 spaced outwardly away from an inner bladder 52 on opposite sides of the inner bladder, such that a space 54 is provided between the inner bladder and the outer bladders. The inner bladder 52 has an anterior portion 56, a posterior portion 60 opposite the anterior portion, and two longitudinal side portions 58 extending between the anterior and posterior portions. The outer bladders 50 extend along the length of the longitudinal side portions 58 and terminate adjacent to the anterior and posterior portions 56 and 60, respectively, of the inner bladder 52. The outer bladders 56 seat the wearer's heel along the sides of the heel for lateral stability when the inner bladder 52 is in the compressed condition and the outer bladders 50 are in the expanded condition.

The interior areas of the inner bladder 52 and outer bladders 50 are connected by a plurality of channels or conduits 62 that extend across the space 54 between the inner and outer bladders. The conduits 62 channel the fluid 29 from the inner bladder 52 to the outer bladders 50 when compressive force is exerted on the inner bladder during heel strike such that the outer bladders expand to the expanded condition. The conduits 62 are shaped and sized to provide the restricted flow of the fluid 29 to the outer bladders to dissipate the ground reaction forces generated during heel strike. Upon release of the compressive force from the inner bladder 52, such as during heel lift in the toe off phase, the outer bladders 50 contract and force the fluid 29 back through the conduits 62 and into the inner bladder 52.

In a second alternate embodiment (not illustrated), the outer bladders 50 extend around the posterior portion 60 of the inner bladder 52, and the outer bladders terminate adjacent to each other rearward of the posterior portion.

Accordingly, the outer bladders 50 are separate and the fluid can not flow directly from one outer bladder into the other. In a third alternate embodiment (not illustrated), the two outer bladders 50 are connected adjacent to the posterior portion 60 of the inner bladder 52, such that fluid can flow directly from one outer bladder into the other. In this third embodiment, outer bladders 50 define a generally horseshoe shape that is sized to seat and stabilize the heel of the wearer, as discussed above.

In the illustrated embodiments, the inner bladders 26 (FIG. 3) and 52 (FIG. 6) have a generally tear-drop shape. In other alternate embodiments, the inner bladder has different shapes, such as an oval or a triangular shape, the outer bladder is positioned outward of the inner bladder so as to seat at least the sides of the wearer's heel, and stabilize the heel during the heel strike phase.

Although the present invention has been described in terms of specific embodiments, changes and modifications can be carried out without departing from the scope of the invention, which is intended to be limited only by the scope of the appended claims.

What is claimed is:

1. A hydrodynamic pad for insertion into a shoe that is adapted to receive a foot of a wearer, the foot having a heel, comprising:

an inner bladder having an anterior portion, a posterior portion, and side portions extending between said anterior and posterior portions, said inner bladder being compressible from an initial condition to a compressed condition;

an outer bladder outwardly adjacent to said side portions of said inner bladder, said outer bladder being expandable from a first condition to a second, expanded condition, said outer bladder having a rounded rear portion extending around said posterior portion of said inner bladder, and having a rounded front portion extending around the anterior portion of the inner bladder, said rounded rear portion defining a first arc having a first radius, and said rounded front portion defining a second are having a second radius that is smaller than the first radius, the outer bladder fully seating the heel when said outer bladder is in said second, expanded condition;

fluid channels extending between said inner bladder and said outer bladder; and fluid in said inner and outer bladders, said fluid being movable between said inner and outer bladders through said fluid channels, said fluid moving from said inner bladder to said outer bladder and expanding said outer bladder from said first condition to said second, expanded condition when said inner bladder is compressed from said initial condition to said compressed condition.

2. The hydrodynamic pad of claim 1 wherein said outer bladder extends around said anterior portion, said posterior portion, and said side portions of said inner bladder.

3. The hydrodynamic pad of claim 1 wherein said inner bladder and said outer bladder are separated by an intermediate bladder wall, and said fluid channels extend through said intermediate bladder wall.

4. The hydrodynamic pad of claim 1 wherein said outer bladder has a substantially teardrop shape with a rounded rear portion adjacent to said posterior portion of said inner bladder.

5. The hydrodynamic pad of claim 1 where said outer bladder includes first and second bladder portions on opposite sides of said inner bladder.

6. The hydrodynamic pad of claim 1 wherein said outer bladder defines a continuous fluid path bladder extending around said inner bladder.

7. The hydrodynamic pad of claim 1 wherein said outer bladder is radially outward of said inner bladder, and said fluid channels extend radially outward from said inner bladder to said outer bladder.

8. The hydrodynamic pad of claim 1 wherein said fluid channels include a plurality of channels substantially distributed around said inner bladder.

9. The hydrodynamic pad of claim 1 wherein said inner bladder is subjectable to a compression load exerted thereon, and said inner bladder is movable from said initial condition to said compressed condition when the compression load is exerted on said inner bladder, said outer bladder is a resilient member that is biased toward the first condition, the outer bladder being sufficiently resilient to force a portion of said fluid through at least one of said fluid channels to said inner bladder when said outer bladder is in said second, expanded condition and said compression load is removed from said inner bladder.

10. The hydrodynamic pad of claim 1 wherein said fluid is a viscous liquid and gas mixture filling said inner and outer bladders.

11. A hydrodynamic pad for insertion in a midsole of a shoe, comprising:

an inner bladder having an anterior portion, two longitudinal side portions and a posterior portion;

an outer bladder positioned radially outwardly from the longitudinal side portions, the anterior portion, and the posterior portion of the inner bladder, and having a configuration resembling a teardrop with a rounded rear portion having a first radius and a rounded front portion having a second radius that is smaller than the first radius;

means for channeling fluid between the inner bladder and the outer bladder; and a fluid contained within the hydrodynamic pad; wherein, upon application of a compressive force to the inner bladder, fluid is displaced from the inner bladder to the outer bladder, expanding the outer bladder, and causing the outer bladder to seat the heel, the outer bladder being capable of forcing the return of at least a portion of the fluid to the inner bladder when at least a portion of the compressive force is removed from the inner bladder.

12. The hydrodynamic pad of claim 11 wherein the outer bladder abuts the inner bladder.

13. The hydrodynamic pad of claim 11 wherein the channeling means comprises a plurality of conduits positioned radially outwardly from at least the longitudinal side portions of the inner bladder.

14. The hydrodynamic pad of claim 11 wherein the pad is made of elastic, puncture-resistant material.

15. A shoe comprising:

an upper component adapted to receive a foot of a wearer;

a midsole component adhered to at least a portion of the upper component;

a hydrodynamic pad inserted in the midsole, wherein the hydrodynamic pad comprises an inner bladder and an outer bladder positioned radially outwardly from the inner bladder, the outer bladder having a configuration resembling a teardrop with a rounded rear portion having a first radius and a rounded front portion having a second radius that is smaller than the first radius, the outer bladder approximately conciding with a bottom periphery of a heel of a wearer with the rounded front portion positioned to extend under the wearer's foot forward of calcaneous bone in the wearer's heel, means for channeling fluid between the inner bladder and the outer bladder, and fluid contained within the hydrodynamic pad, the fluid being capable of flowing outwardly from the inner bladder to the outer bladder through the means for channeling fluid upon heel impact generating a center of distribution radiating from the inner bladder, and wherein the hydrodynamic pad is positioned in the midsole in a manner whereby the outer bladder seats the heel when the outer bladder is expanded by the outward flow of fluid resulting from heel impact, and wherein the outer bladder is capable of forcing the return of at least a portion of the fluid to the inner bladder when at least a portion of the force is removed from the hydrodynamic pad; and an outsole adhered to at least a portion of a bottom face of the midsole.

16. The shoe of claim 15 wherein the outer bladder abuts the inner bladder.

17. The shoe of claim 15 wherein the channeling means comprises a plurality of conduits positioned radially outwardly from at least the longitudinal side portions of the inner bladder.

18. The shoe of claim 15 wherein the hydrodynamic pad is made of elastic, puncture-resistant material.

19. A method of stabilizing a foot in a shoe while dissipating impact forces generated during heel strike, comprising:

providing a hydrodynamic pad under a heel of the foot, the heel having a calcaneous bone therein, the hydrodynamic pad comprising an inner bladder having a front portion, two side portions and a rear portion, a substantially teardrop-shaped outer bladder positioned outwardly around the inner bladder's front, side, and rear portions, fluid channels extending between the inner and outer bladders, and a fluid that is movable between the inner and outer bladders through the fluid channels, the inner bladder being positioned under the calcaneous bone of the heel, and the outer bladder being positioned approximately under the periphery of the calcaneous bone;

impacting the hydrodynamic pad with the impact forces to compress the inner bladder and forcing at least a portion of the fluid outwardly through the fluid channels from the inner bladder into the outer bladder thereby dissipating the impact forces transmitted to the foot;

expanding the outer bladder to receive said at least a portion of the fluid and seating the calcaneous bone of the foot in the outer bladder and stabilizing the foot in the shoe when the outer bladder is expanded during heel strike with the outer bladder extending substantially fully around the bottom periphery of the heel;

removing the impact forces from the inner bladder after the outer bladder has been expanded; and contracting the outer bladder when the impact forces are removed from the inner bladder and returning at least a portion of the fluid through the fluid channels from the outer bladder to the inner bladder.

* * * * *